US006350077B1

(12) United States Patent
Palmquist

(10) Patent No.: US 6,350,077 B1
(45) Date of Patent: Feb. 26, 2002

(54) SWIVEL CONNECTION

(76) Inventor: Björn Palmquist, 412 70, Göteborg (SE)

( * ) Notice: Subject to any disclaimer, the term of this patent is extended or adjusted under 35 U.S.C. 154(b) by 0 days.

(21) Appl. No.: 09/604,388

(22) Filed: Jun. 27, 2000

Related U.S. Application Data

(63) Continuation of application No. PCT/SE98/02467, filed on Dec. 30, 1998.

(30) Foreign Application Priority Data

Dec. 30, 1997 (SE) ..... 9704936

(51) Int. Cl.[7] ..... B25G 3/00; F16B 9/00; F16L 41/00

(52) U.S. Cl. ..... 403/235; 403/314; 403/313; 403/312

(58) Field of Search ..... 403/344, 301, 403/302, 305, 313, 312, 314, 235

(56) References Cited

U.S. PATENT DOCUMENTS 3,551,960 A * 1/1971 Little ..... 24/123
3,672,613 A * 6/1972 Oriani ..... 248/62
4,128,355 A * 12/1978 Leaf ..... 403/222
4,149,336 A * 4/1979 Huse ..... 43/44.9
5,154,652 A * 10/1992 Ecklesdafer ..... 440/83
6,010,273 A * 1/2000 Metzler, Jr. ..... 403/314

FOREIGN PATENT DOCUMENTS

GB 2096963 10/1982
WO WO 85/01713 4/1985

* cited by examiner

*Primary Examiner*—Lynne H. Browne
*Assistant Examiner*—John B. Walsh
(74) *Attorney, Agent, or Firm*—Samuels, Gauthier & Stevens, LLP

(57) ABSTRACT

The present invention relates to a clamping joint for joining a ramification line (15) to an anchoring wire (13), comprising a clamping mechanism comprising two halves (18) split in the longitudinal direction of the wire, which clamping mechanism clamps around the wire via one in each half provided wire channel half (20), whereby the wire channel (20) formed by the two halves is such dimensioned that it is in a position mounted around the wire (13) provides an interspace which is filled by a deformable insert (21) provided in said interspace for locking the clamping mechanism with regard to rotation around the wire, and that the clamping mechanism is provided with a sliding surface for a shackle (24) being arranged around the clamping mechanism which shackle forms a fastening point for a ramification line (15).

1 Claim, 4 Drawing Sheets

SWIVEL CONNECTION

This application is con of PCT SE 98/2467 Dec. 30, 1998.

DESCRIPTION

1. Technical Field

The present invention relates to a clamp including a swivel function for connecting a surface crossing or a subsurface buoy to a six twined anchoring line (steel wire) which most often is used for anchoring floating off-shore units. The clamp comprises a clamping means consisting of two halves split in the longitudinal direction of the wire to clamp around the wire.

2. Background of the Invention

In the following description, line and steel wire are used in parallel. The steel wire is that typically used for anchoring floating off-shore units.

Wire clamps are used for connecting floating elements (buoys) to lift anchoring lines above hinder on the sea bottom, such as a pipeline, or other submarine construction. The buoys can further be used for locally reducing the weight of a line.

Certain off-shore units will be anchored using 8 to 12 wire lines (2 to 3 lines in each corner of the unit) connected in their opposite ends to an anchor. The diameter of the lines varies commonly from about 64 mm to 90 mm and the length is typically about 2000 to 2300 m.

As these units often are moved between different positions, it means that different crossing points between the line and different pipelines occur. It becomes necessary to be able to attach, in a simple way, floating elements to the line in order to lift it above the crossing point without damaging or splitting the same.

When the line is subject to different tensile strengths, the line may be torn due to torsion forces. The lines vary in diameter and connected length. It is also very important that the buoy joint to the line itself does not move its position along the line.

An anchoring line costs about 500,000 to 700,000 crowns (SEK) and thus it is of utmost importance that the buoy attachment does not damage the line. Damages can occur from pure wear but also by means of exhaustion if the construction is not completely reliable.

THE TECHNICAL PROBLEM

The object of the present invention is to obtain a buoy attachment solving the above mentioned problems and simultaneously fulfills all above mentioned requirements in a simple and rational way.

DESCRIPTION OF THE PRESENT INVENTION

These problems can be overcome by means of the present invention. A clamping mechanism includes two semicircular segments. When the clamping mechanism is positioned around a wire, an inner space is formed. The inner space is filled with an insert molded from polyurethane for locking the clamp in an axially and rotationally fixed relationship with respect to the wire. The clamp means is provided with a sliding surface for a schackle being rotatably arranged around the clamp means which swivel forms a fastening point for a ramification line.

The two segments of the clamping mechanism are typically made from steel and have inlets and outlets formed as trumpet nozzles. They are coated with a thin layer (about 5 mm) of a polyurethane which is further formed with a unique impression of the steel wire.

The bending radiuses of the steel halves laid together (of the trumpet nozzles) shall never be less than 9 times the diameter of the line in order to avoid exhaustion damages of the line.

The imprint of the steel wire which is preferably placed in the center of each steel half has a length of about 500 mm in order to allow a simple mounting but simultaneously achieve a high longitudinal retaining force. If the imprint is made longer, the mounting of the wire clamp is made more difficult as the diameter of the lines varies somewhat along the length thereof.

The hardness of the polyurethane layer arranged upon the steel halves must be flexible, have a high retention force, and admit a simple mounting. A hardness corresponding to A-95 of the standards given has seemed to be suitable.

In order to absorb the rotation of the line where the outer part with the inbuilt schackle constructed with an over measure.

As the size of the floating element varies and large dynamic forces can develop in the buoy line it is required that a high strength schackle is used. For a 76 mm anchoring line, a schackle having the mark SWL 85 Tonnes is normally used, which has been adapted by manufacturing and thereby degraded to a SWL 50 Tonnes schackle. Using a normal security factor of 5, a tensile strength of at least 200 Tonnes (200,000 kg) is achieved. Also specially designed schackles having the right geometry will be used.

The two steel halves are further so constructed that a clamping force is always achieved at different loads in the line as they do not completely circumference the whole periphery of the line.

DESCRIPTION OF THE DRAWINGS

The invention will be described in the following with reference to the embodiment shown on the attached drawings on which

DESCRIPTION OF THE EMBODIMENT

Figure 1:
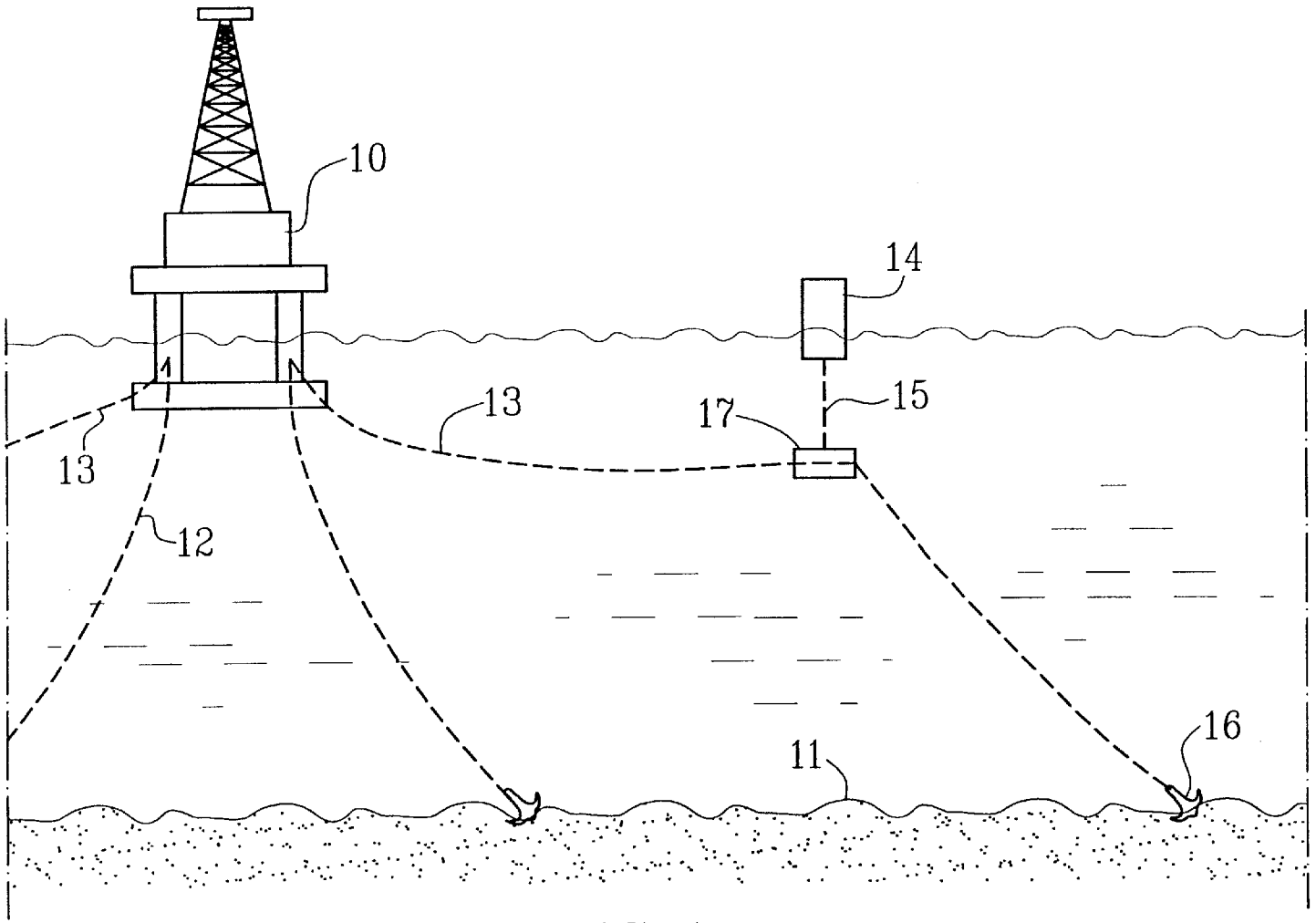
FIG. 1 shows a schematic view of area of use of the invention.

The floating unit 10 shown in FIG. 1 is anchored to the sea bottom 11 optionally by means of chains 12, partly by means of anchoring wires 13. A buoy 14 is connected to the anchoring wire 13 via a ramification line 15. The ramification line 15 is connected to the wire 13 via a swivel joint 17.

Figure 2:
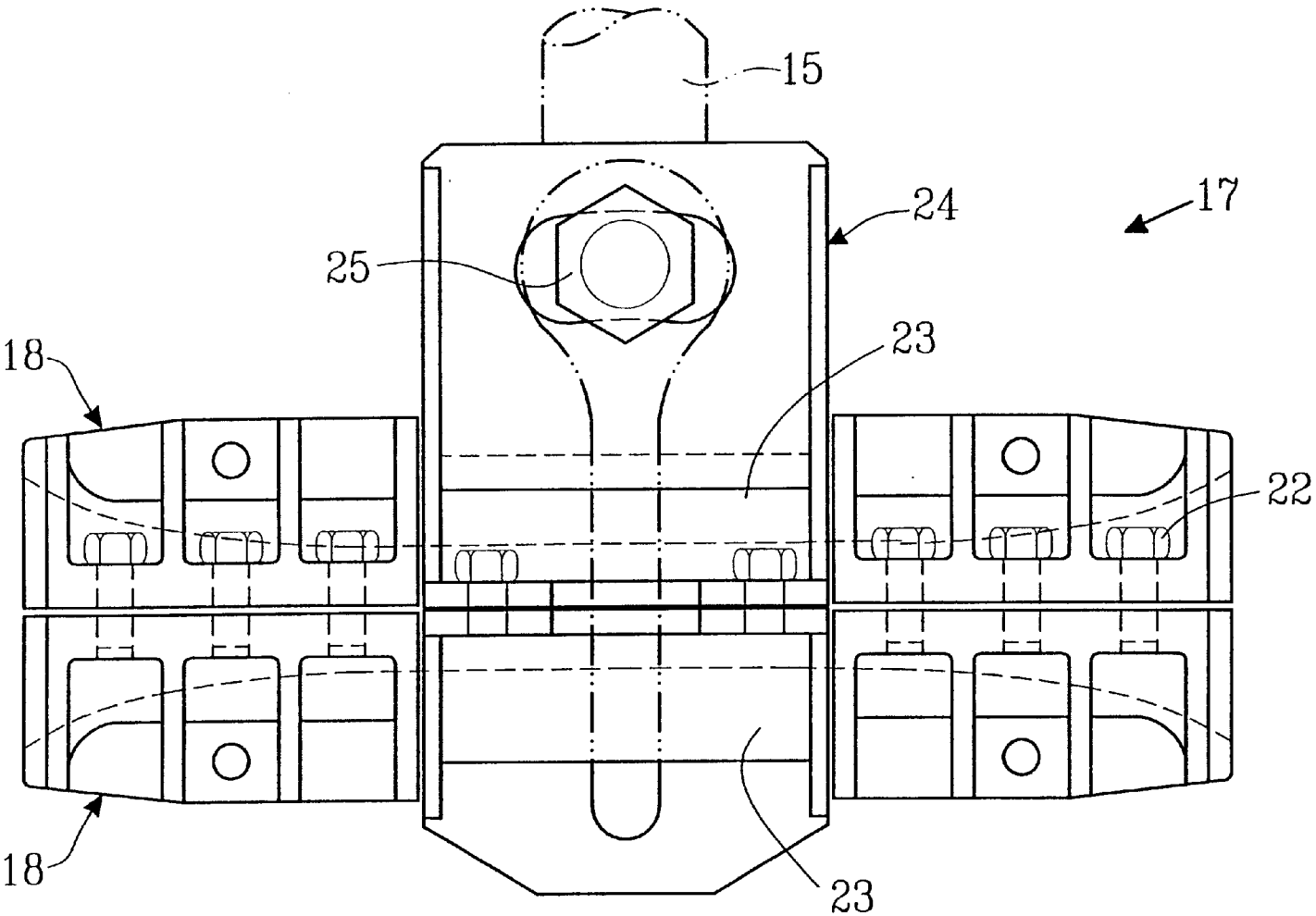
FIG. 2 shows a lateral view of the joint according to the invention.
Figure 3:
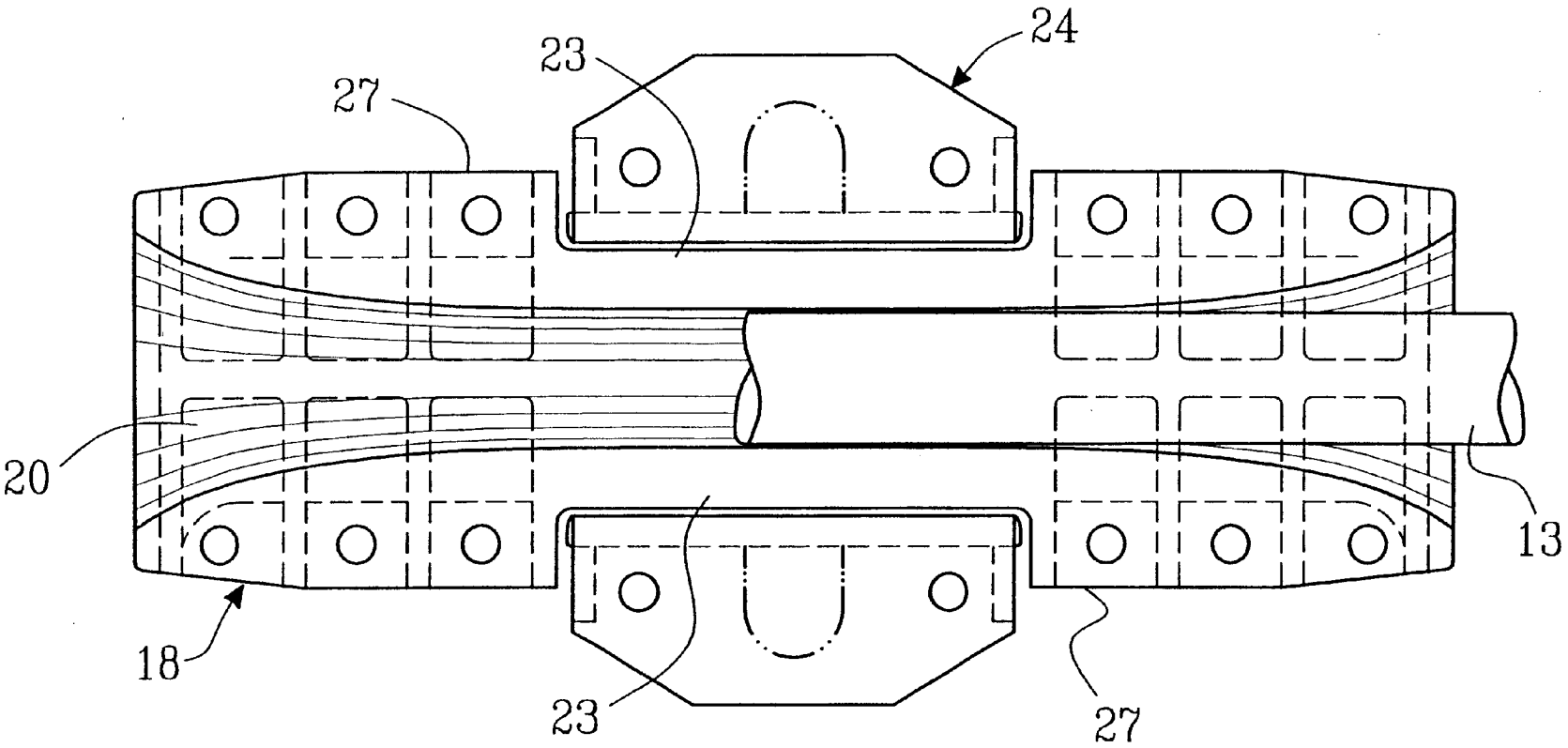
FIG. 3 is a lateral view in cross section of the joint of FIG. 2 turned 90°.
Figure 4:
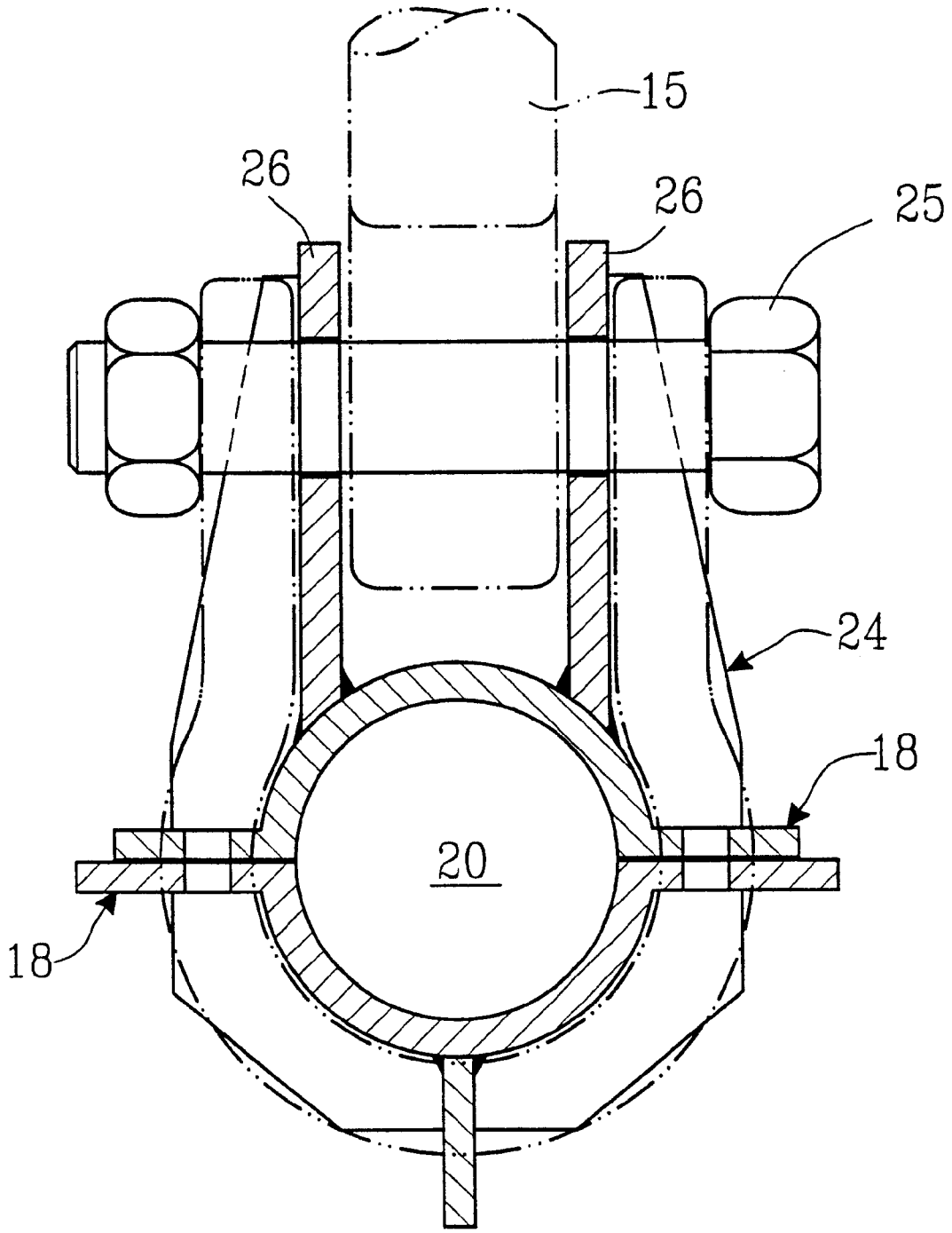
FIG. 4 is a cross sectional view of the joint of FIG. 2 perpendicular to the anchoring wire.

FIG. 2 shows the swivel joint 17 more in detail. The joint 17 comprises a clamping means 18 consisting of two symmetrically designed halves 18 split longitudinal to the wire. This clamping means grips around the wire 13 via one wire channel half 20 arranged in each half of the means (cf FIG. 3). The channel formed by the two halves is so dimensioned such that when the clamping mechanism is in a mounted relationship around the wire, an interspace is formed. The interspace is filled by a thin layer of a polyurethane having an imprint of the actual wire. The imprint is obtained in such a way that a length of a wire having the actual dimension is brought in between the steel halves and by means of distance holding means placed centrally between the two halves. Then polyurethane is poured in between the wire and the steel halves and is allowed to harden. The two clamping means halves 18 are drawn together by means of twelve screws 22, suitably using such a force that cold welding occurs between the insert and the surrounding surface of the wire. This provides for a tight joint which reduces the risk for corrosion and locks the clamping means in relation to a rotation around the wire. This molding/geometry receives the horizontal (longitudinal) forces acting upon the joint.

A waist part 23 of the clamping means forms a sliding surface for a schackle 24 mounted around the clamping means. The schackle has a schackle bolt which forms a hold for the ramification line 15. The schackle 24 is mounted in a hold 26 consisting of two halves, by means of screws 25. The hold on one hand distributes the tensile force coining from the ramification line 15 over a wider surface of the waist part, and, on the other hand, keeps the schackle substantially perpendicular in relation to the longitudinal direction of the wire. The clamping means 18 proceed on both sides of the waist part 23 into diametrically wider end parts 27.

The invention is not restricted to the embodying example described above but several variants are thought within the frame work of the accompanying claims.

What is claimed is:

1. A clamping joint for joining a ramification line to an anchoring wire, said clamping joint comprising: clamping means for securing the wire to said clamping joint, said clamping means include two semicircular segments, said segments for being secured in an operative position tightly surrounding the wire, such that when said segments are in an operational position there is a channel between said segments for the wire, said channel also provides for an interspace between said segments and the wire, said interspace is filled by a deformable insert, said insert is molded from polyurethane and includes an imprint of the wire, such that in the operational position said clamping means are in an axially and rotationally fixed relationship with respect to the wire; a shackle positioned around the clamping means for fastening a ramification line to said clamping joint.

* * * * *